United States Patent [19]

Masuda et al.

[11] 4,313,741

[45] Feb. 2, 1982

[54] ELECTRIC DUST COLLECTOR

[76] Inventors: Senichi Masuda, 605 Nishigahara 1-chome, Kita-ku, Tokyo, Japan, 114; Naoki Sugita, 52-Izumi-cho, Itabashi-ku, Tokyo, Japan, 174

[21] Appl. No.: 170,911

[22] Filed: Jul. 21, 1980

Related U.S. Application Data

[63] Continuation-in-part of Ser. No.39,206, May 15, 1979, abandoned.

[30] Foreign Application Priority Data

| | | | |
|---|---|---|---|
| May 23, 1978 | [JP] | Japan | 53-61426 |
| May 23, 1978 | [JP] | Japan | 53-61427 |
| Jul. 18, 1978 | [JP] | Japan | 53-87319 |
| Jul. 28, 1978 | [JP] | Japan | 53-91560 |
| Nov. 22, 1978 | [JP] | Japan | 53-161115[U] |

[51] Int. Cl.[3] ..... B03C 3/12; B03C 3/45

[52] U.S. Cl. ..... 55/138; 55/141; 55/143; 55/145; 55/146; 55/155; 55/156

[58] Field of Search ..... 55/138, 141, 142, 143, 55/145, 146, 155, 156; 131/262 B; 174/126 C

[56] References Cited

U.S. PATENT DOCUMENTS

| | | | |
|---|---|---|---|
| 2,473,240 | 6/1949 | Byrne | 55/143 |
| 2,650,672 | 9/1953 | Barr et al. | 55/138 |
| 2,813,595 | 11/1957 | Fields | 55/143 |
| 2,822,057 | 2/1958 | Ricaardson | 55/143 |
| 2,868,319 | 1/1959 | Rivers | 55/132 |
| 2,970,670 | 2/1961 | Nodolf | 55/138 |
| 2,974,747 | 3/1961 | Coolidge, Jr. et al. | 131/262 B |
| 3,040,498 | 6/1962 | Berly | 55/143 |
| 3,173,774 | 3/1965 | Getzin | 55/138 |
| 3,803,808 | 4/1974 | Shibuya et al. | 55/138 |
| 3,849,090 | 11/1974 | Remick | 55/138 |
| 3,973,932 | 8/1976 | Alskog | 55/142 |

FOREIGN PATENT DOCUMENTS

| | | | |
|---|---|---|---|
| 600907 | 7/1960 | Canada | 55/142 |
| 752474 | 8/1952 | Fed. Rep. of Germany | 55/145 |
| 675300 | 2/1930 | France | 55/145 |
| 1109084 | 1/1956 | France | 55/155 |

*Primary Examiner*—David L. Lacey
*Attorney, Agent, or Firm*—George B. Oujevolk

[57] ABSTRACT

In an electric dust collector including a case having a dust-containing gas inlet and a clean gas outlet; a charging section for electrically charging the dust particles by means of the corona discharge on the side of said dust-containing gas inlet of said case; a collecting section for collection the dust particles passing through said charging section and electrically charged, by means of the Coulomb force; and a d.c. high voltage power source for applying a d.c. high voltage to said charging section and to said collecting section; the present invention discloses an electric dust collector wherein each electrode plate of said collecting section consists of a ribbon-like insulation film strip and an electrically conductive layer or layers having a width narrower than that of said film and formed on either one face or both faces of said film so as to form insulation sections on both side edges of said conductive layer or layers, and said collecting section consists of a plurality of said electrode plates would up spirally or laminated with each other with a predetermined gap between them via insulation spacers of an insulation material disposed on said insulation sections so as to allow the passage of the gas therethrough.

5 Claims, 36 Drawing Figures

ELECTRIC DUST COLLECTOR

This application is a continuation-in-part of U.S. patent application Ser. No. 39,206 filed May 15, 1979 now abandoned.

BACKGROUND OF THE INVENTION

The present invention principally relates to an electric dust collector for cleaning the air inside a room.

Heretofore, as a conventional electric dust collector for cleaning the indoor air, there has been used a two-stage system electric dust collector equipped with a charging section for electrically charging the dust particles using corona discharge and a collecting section for collecting the dust particles by means of the Coulomb force consisting of positive and negative parallel flat electrode plates. In addition to its complicated construction and its high cost of production, this electric dust collector is extremely difficult to reduce the apparatus in size and cannot enhance its dust collecting performance by making narrower the gaps between the positive and negative electrodes of the dust collecting section.

This arises from the fact that when the electrode gap is markedly reduced, insulation becomes difficult.

In addition, the conventional electric dust collector is not free from the following problems. Namely, when it is desired to clean the air containing odor particles such as tobacco smoke by the conventional electric dust collector, an offensive odor remains in the particle collecting section and is then carried over by the cleaned air. Though it is therefore desired to replace the particle collecting zone, the apparatus is so constructed that the particle collecting section is not replacable and even if it is possible, the particle collecting section is expensive or difficult to replace. Hence, one has to wait till the residual offensive odor disappears naturally with the passage of time.

Further, the particle collecting section of the conventional electric dust collector involves another problem in that if the gap between the electrodes is kept narrower than the quenching distance (that is, a distance that prevents ignition of an inflammable gas coming into the electrode gap when spark occurs), it is certainly possible to expect the quenching effect and thus to prevent the ignition, but when the spark occurs in the proximity of the electrode plates, the quenching effect is not provided and the danger of ignition is therefore present.

Hereinafter, these problems will be explained more definitely.

The conventional particle collecting section is shown in FIG. 1 wherein a corrugated insulation spacer 3 is interposed between and over the entire surfaces of electrically conductive electrode plates 1 and 2 or such a construction as shown in FIG. 2 wherein one of, or both, electrode plates 1 and 2 is covered with an insulation material 4. However, these constructions have the following disadvantages, respectively.

As to the former:

I. The charged particles are to pass either through the space S or the space S' of the particle collecting section. When the particles 5 charged with a positive charge pass through the space S, they are subjected to the Coulomb force arising from the electric field formed by a voltage V applied across the electrode plates 1 and 2, so that the particles travel towards the negative electrode plate 2 and attach to the surfaces of the spacer 3 as depicted in FIG. 3. On the other hand, when the particles 6 charged with a negative charge pass through the space S', they also are subjected to the Coulomb force so that they travel toward the positive electrode plate 1 and attach to the surfaces of the spacer 3 as depicted in FIG. 4. In this instance, since the spacer 3 is made of an insulation material, the charges of the particles 5 and 6 stay on the surfaces of the spacer 3 and build-up thereon whereby the electric field generated by themselves offsets the electric field applied across the electrode plates 1 and 2 and the electric field of either the space S or of the space S' is weakened.

When the electrically conductive particles such as nicotine and tobacco tar smoke attach to the surfaces of the spacer 3 and build up gradually thereon, electrically conductive layers 7 and 8 are formed on both surfaces of the spacer 3, so as to create a situation similar to that where the electrode plate 1 extends up to the conductive layer 7 inside the space S while the electrode plate 2 extends up to the conductive layer 8 inside the space S'. In consequence, no electric field is given to the space S or to the space S' even when a voltage V is applied across the electrode plates 1 and 2.

For this reason, the dust collecting efficiency lowers with the lapse of usage time and the service life of the dust collector is short, although the collector provides good dust collecting efficiency at the initial stage.

II. Since the spacer 3 is interposed between and over the entire surfaces of the electrode plates 1 and 2, a leakage current flowing from one of the electrode plates to the other through the surfaces of the spacer 3 is great. Especially when the humidity is high, contaminants attaching to the surfaces of the spacer 3 absorb the moisture and enlarge the conductivity, thus resulting in the drop of the power source voltage and lowering of the dust colllecting efficiency. Hence, practical utility is poor.

III. If the capacity of the particle collecting section is the same, it is possible to increase the number of electrode plates and thus to enhance the dust collecting efficiency by narrowing the gap between the electrode plates 1 and 2. If the number of the electrode plates remains the same, it is possible to reduce the capacity of the particle collecting section and hence, to reduce the size of the electric dust collector. In spite of these advantages, the electric field tends to concentrate on the edge portions of the electrode plates 1 and 2 or fiber-like dusts tend to bridge the electrode plates 1, 2 so that the spark will occur more readily. This leads to various problems such that application of a high voltage becomes impossible; an offensive noise occurs; and the electrode plates are scorched or melted and thus degraded, thereby resulting in causes for possible fire. Accordingly, it is practically impossible to narrow the gap between the electrode plates and consequently, to render the electric dust collector more compact.

IV. In order to narrow the electrode gap and at the same time, to prevent occurrence of the spark, the following methods may be theoretically possible, but each is not free from the peculiar problems.

(i) A method which removes in advance coarse or fiber-like dusts by use of a pre-filter.

In order to efficiently remove dust by use of a pre-filter having a fine mesh in accordance with this method, it is necessary to apply a high pressure so as to pass the air through the electric dust collector. To meet with this requirement, the use of a large-sized blower becomes necessary and there again occur other problems such as the increase in noise, the consumption of a greater electric power and so forth. In other words, if a pre-filter having a large mesh is used in order to minimize the pressure loss, it becomes impossible to sufficiently remove the dust and hence, to prevent the occurrence of the spark.

(ii) A method which lowers the voltage to such a level where no spark occurs so as to weaken the electrolysis of the particle collecting section.

This method has the drawback in that the dust collecting efficiency is inevitably lowered.

(iii) A method which covers the edge of the electrode plate with an insulation material.

This method contemplates preventing the ready occurrence of a spark as the electric field concentrates on the edge of the electrode plate. However, the spark occurs not only at the edge of the electrode plate but also at its central portion. This tendency is remarkable when the fiber-like dust attaches to the surface. In such a case, this method becomes practically useless.

(iv) A method which covers both, or one, of the positive and negative electrode plates with an insulation material.

Since the electric field or voltage in the insulating material at which no spark occurs is about 10 times higher than that of the air, this method is certainly useful for the prevention of the occurence of a spark, but it is not free from the problem of the build-up of the charge.

As to the latter:

Since the electrode plate is covered with the insulation material 4, it is possible to prevent the occurrence of the spark in the same way as in the abovementioned method (iv). However, when the charged particles 5 attach to the insulation material 4 as depicted in FIG. 2, the electric charge does not escape but stays on the surfaces of the insulation material, thereby weakening the electric field. Since this latter construction is also provided with the spacer 3 of any sort as shown in FIG. 6, the dusts attaching to the surfaces of the spacer, if any, form the conductive layers, thereby eliminating the electric fields of the spaces S and S'.

SUMMARY OF THE INVENTION

The present invention is therefore directed to provide a novel two-stage system electric dust collector which altogether solves all the abovementioned problems of the conventional apparatus and which is compact in size, has high performance and is economical to produce.

The abovementioned objects of the invention can be accomplished by the use of electrodes obtained by forming an electrically conductive layer or layers having a width narrower than that of an elongated flat insulation film strip on one surface or both surfaces of said film thereby to form insulation sections on both side edges of said conductive layer or layers.

Namely, in an electric dust collector of the type including a case as the main frame of the dust collector having a dust-containing gas inlet and a clean gas outlet; a charging section for electrically charging the dust particles on the side of said dust-containing gas inlet inside said case by means of the corona discharge; a collecting section for collecting the dust particles charged electrically after passing through said charging section, by means of the Coulomb force; and a d.c. high voltage power source for applying a d.c. high voltage to said charging section and to said collecting section; the novel electric dust collector in accordance with the present invention is characterized in that each electrode of said particle collecting section consists of a ribbon-like insulation film and a conductive layer or layers having a width narrower than that of said insulation film and so formed on both surfaces or on one surface of said film to define insulation sections on both side edges of said conductive layer or layers, and a plurality of said electrodes are either wound up or laminated with each other with a predetermined gap between them via spacers of an insulation material allowing the passage therethrough of the gas thereby to form said particle collecting section whereby insulation between said electrodes adjacent to each other is effected by means of said insulation sections formed on both side edges of said ribbon-like insulation film strip in cooperation with said insulation spacers interposed between said insulation sections.

Accordingly, the electric dust collector in accordance with the present inventive concept provides for an electrode of simple construction and reduces the cost of production and simplifies the perfection of the insulation between electrodes, while the gap between electrodes is kept extremely narrow, as will be more readily apparent from the following detailed description and the accompanying drawings, in which:

BRIEF DESCRIPTION OF THE DRAWINGS

FIGS. 7 through 34 illustrates the embodiments of the present invention, respectively, wherein:

FIG. 7 is a sectional view showing the overall construction of the apparatus of the present invention;

FIG. 8 is a sectional view of the spiral type particle collecting section;

FIG. 9 is a partially cutaway front view of FIG. 8;

FIG. 10 is a sectional view of a modified example of the spiral type particle collecting section;

FIG. 11 is a sectional view taken along line A-A of FIG. 10;

FIG. 13 is a schematic view showing another construction of the present invention;

FIG. 14 is a perspective view of the electrode plate forming the laminate type particle collecting section;

FIG. 15 is a partially cutaway plan view of the electrode plate of FIG. 14;

FIG. 16 is a plan view of the electrode plate of FIG. 15 when its direction is reversed;

FIG. 17 is a perspective view of the electrode plates when they are laminated;

FIG. 18 is a schematic view of the particle collecting section as a whole formed by the abovementioned electrode plates;

FIG. 19 is a perspective view of a modified example of FIG. 17;

FIG. 20 is a perspective view of still another modified example of FIG. 17;

FIG. 21 is a perspective view of a modified example of the spacer;

FIG. 22 is a sectional view of a modified example of the particle collecting section;

FIG. 23 is a schematic view useful for explaining the state in which the charge of the electrode plates of the dust collecting section of FIG. 22 is absorbed;

FIG. 24 is a schematic view of the dust collecting section as a whole of FIG. 23;

FIG. 25 is a perspective view of a modified example of the electrode plate of FIG. 14;

FIG. 26 is a side view of the electrode plates of FIG. 14 when they are laminated;

FIG. 27 is a sectional view of FIG. 26;

FIG. 28 is a perspective view of the exploded state of the particle collecting section to be assembled by the electrode plates of FIG. 14;

FIG. 29 is a perspective view during the assembly;

FIG. 30 is a partially sectional view of FIG. 29;

FIG. 31 is a schematic view of the electric dust collector incorporating therein the particle collecting section of FIG. 28;

FIG. 32 is a perspective view of a modified example of the electrode plate of FIG. 25;

FIG. 33 is a sectional view of the particle collecting section assembled by the electrode plates of FIG. 32; and FIG. 34 is a perspective view of another modified example of the electrode plate of FIG. 25;

DETAILED DESCRIPTION OF THE PREFERRED EMBODIMENTS

Hereinafter, the features and construction of the novel electric dust collector in accordance with the present invention will be explained in detail with reference to the preferred embodiments thereof in conjunction with the accompanying drawings.

The explanation will first be given of an electric dust collector using a particle collecting section that comprises even-numbered electrodes wound spirally, each electrode consisting of a ribbon-like insulation film having conductive layers formed on its both sides.

Figure 1:
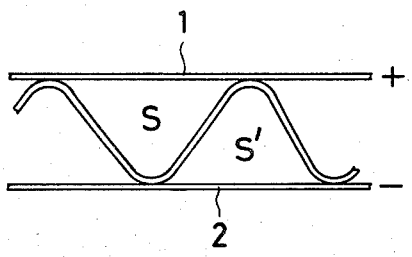
FIG. 1 PRIOR ART
FIG. 1 is a schematic view of an example of the particle collecting section of the conventional electric dust collector.
Figure 2:
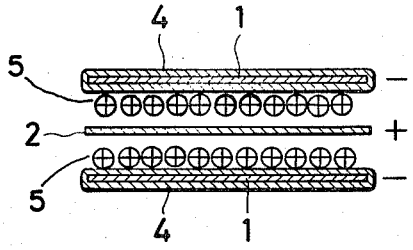
FIG. 2 PRIOR ART
FIG. 2 is a schematic view of another example of the particle collecting section.
Figure 3:
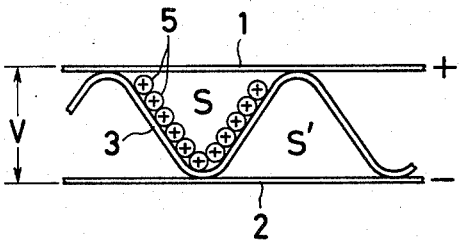
FIG. 3 PRIOR ART
FIG. 3 is a schematic view of the particle collecting section of FIG. 1 to which electric charges are deposited.
Figure 6:
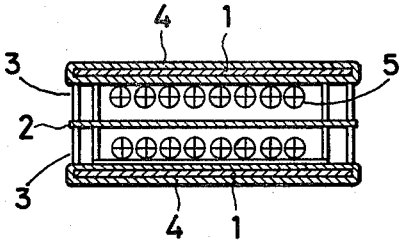
FIG. 6 PRIOR ART
FIG. 6 is a schematic view of the particle collecting section of FIG. 2 to which dust attaches.
Figure 4:
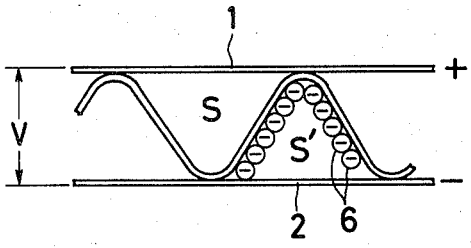
FIG. 4 PRIOR ART
FIG. 4 is a schematic view of the particle collecting section of FIG. 1 to which electric charges are deposited in another state.
Figure 7:
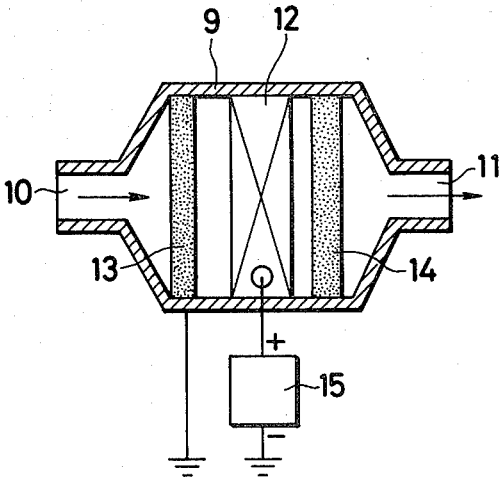
Figure 5:
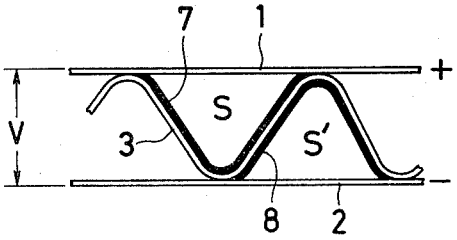
FIG. 5 PRIOR ART
FIG. 5 is a schematic view of the particle collecting section of FIG. 1 to which particular types of dust attaches.

Referring to FIG. 7, reference numeral 9 denotes a casing; 10 is a dust-containing gas inlet; 11 is a clean gas outlet; 12 is a dust-collecting section consisting of a charging section and a particle collecting section; 13 is a pre-filter; 14 is an active carbon filter for removing ozone and $NO_x$ that are formed by corona discharge; and 15 is a d.c. high voltage power source.

Figure 8:
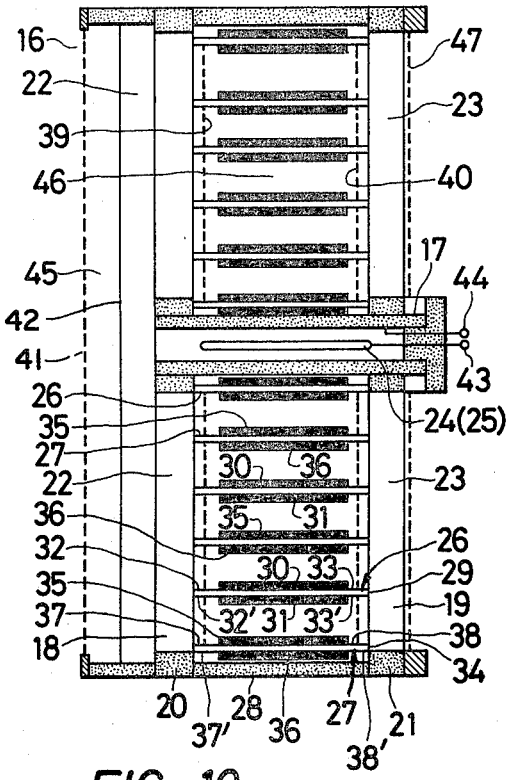
Figure 9:
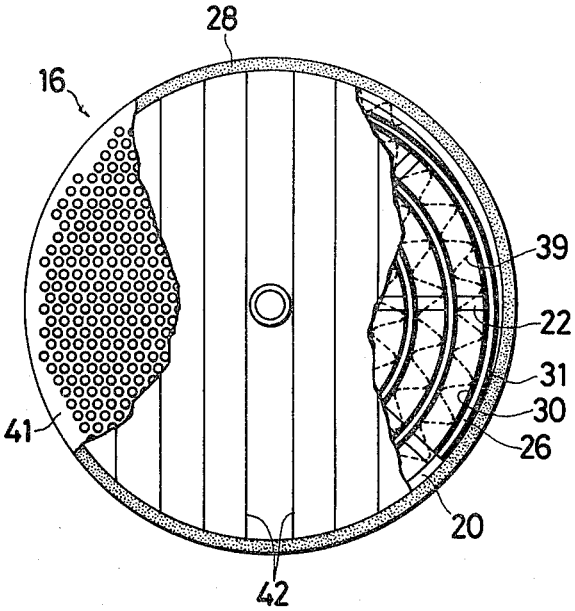

FIGS. 8 and 9 illustrate an example of the dust-collecting section 12. In the drawings, reference numeral 16 represents a take-up reel and frame wheels 18, 19 made of an insulation material are fitted to both ends of an insulation cylinder 17 coaxially therewith. The frame wheels 18, 19 are provided with rings 20, 21 and a number of radial support arms 22, 23 while a pair of slits 24, 25 are provided in the cylinder 17 in the axial direction. One end each of negative and positive electrodes 26, 27 is inserted into each slit 24, 25 and secured thereto. These electrodes 26, 27 are wound onto the take-up reel 16 and their outside is fastened by an insulating band 28.

The negative electrode 26 consists of a ribbon-like insulation film 29 as a base having conductive layers of ribbon-like metal foils 30, 31 attached to both sides of the film. The metal foils have a width considerably narrower than that of the film and are bonded to the central portion of the film, thereby forming the conductive layers, in such a manner that both side edges of the foils are positioned sufficiently inwardly from both side edges of the film, thus forming insulation sections, 32, 32' and 33, 33' each having a sufficient width.

Similarly, the positive electrode 27 consists of a ribbon-like insulation film 34 as a base having conductive layers of ribbon-like metal foils 35, 36 having a width considerably narrower than that of the film and bonded to the central portion of the film in such a manner that side edges of the foils are positioned sufficiently inwardly from both side edges of the film, thereby forming insulation sections 37, 37' and 38, 38' each having a sufficient width.

Besides the method of bonding the ribbon-like metal foils to the film, the conductive layers of the electrodes 26, 27 may be formed by various methods such as coating of a conductive paint onto the film, plating of a metal, vacuum-deposition of a metal or the like.

Reference numerals 39 and 40 represent corrugated spacers having a narrow width that are bonded and secured along the insulation sections on one side of each electrode 26, 27, to keep a predetermined electrode gap when the electrodes 26, 27 are wound up and allow the passage of a gas in the direction indicated by an arrow in FIG. 7.

A sufficiently wide space between the corrugated convolutions is kept between the metal foils 35 and 30 and between 36 and 31 that face each other with the gap of the negative and positive electrodes 26, 27 via the insulation sections 37, 37', 38, 38' of the films 34, 29—the support arms 22, 23—the insulation sections 32, 32', 33, 33'. For this reason, a leakage current due to the contamination is reduced and the insulation between the negative and positive electrodes 26, 27 is improved markedly. This is the greatest advantage brought forth by the construction as the feature of the present invention in that the electrodes are formed on the ribbon-like insulation films with their width being narrower than the width of the film.

In FIG. 8, reference numeral 41 denotes a metal net electrode or a punched metal which is secured and grounded outside the frame wheel 18 coaxially with it and faces a positive corona discharge wire 42.

The negative terminal 43 of the d.c. high voltage power source 15 is grounded together with the case 9. Also grounded is the metal net electrode 41 and the negative electrode 26, while the positive terminal 44 is wired to the positive electrode 27 so that a positive corona discharge is generated from the corona discharge wire 42 toward the metal net electrode 41, thereby froming a charging section 45. For forming the charging section 45, a large number of possible constructions are available such as one using thin wires, one consisting of plural wires spaced apart from each other or the like and a suitable other construction may optionally be used.

In the embodiment having the aforementioned construction, the dust particles of the dust-containing gas flowing from the gas inlet 10 in the direction indicated by an arrow through the filter 13 are positively charged by positive ions at the charging section 45, then enter the particle collecting section 46 where there is formed a d.c. electric field between the negative and positive electrodes 26 and 27, and are rapidly collected onto the electrode by means of the Coulomb force. In this case, a considerable amount of the dust particles are collected by the metal net electrode 41 thereby reducing contamination of the collecting section 46 to a marked extent.

From the gas cleaned in this manner, ozone and $NO_x$ are removed by the active carbon filter 13 and the gas is thereafter discharged from the outlet 11.

Reference numeral 47 represents an arrester which consists of a grounded metal net and is coaxially fitted outside the frame wheel 19. This prevents propagation of a flame to the outside even if flame occurs accidentally inside the dust collecting section 12 and if an inflammable gas is by any chance present thereinside and ignited by the flame.

Figure 10:
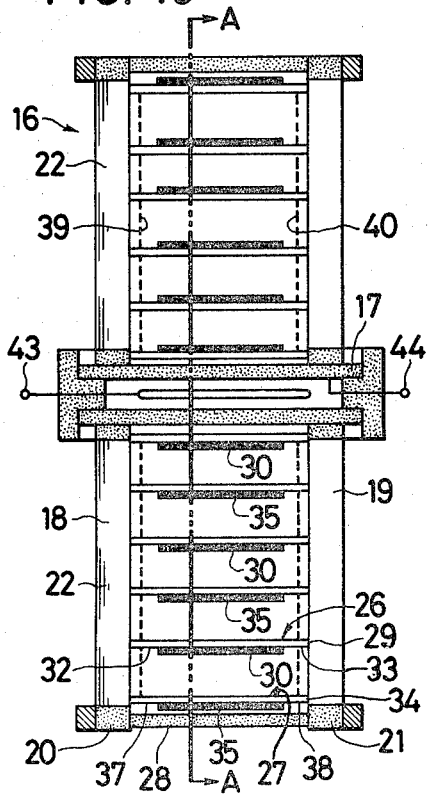
Figure 11:
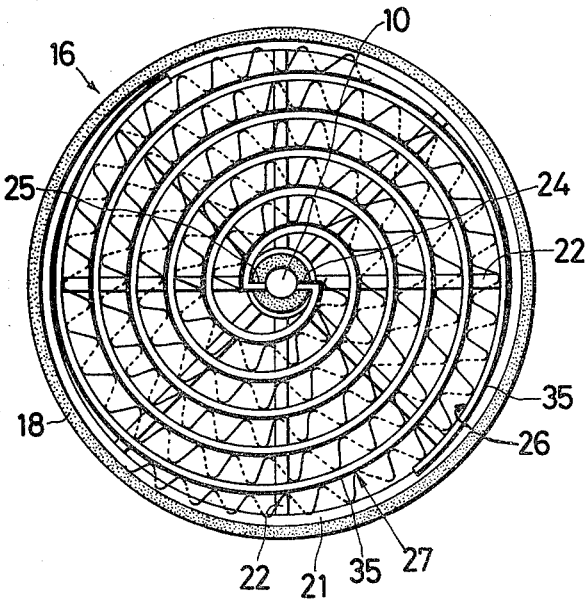

Next, the explanation will be given with reference to FIGS. 10 through 12 on the electric dust collector using the particle collecting section comprising even-numbered electrodes wound up spirally, each of said electrodes consisting of a ribbon-like insulation film strip and an electrically conductive layer formed on one surface of the insulation film.

Since this electric dust collector is exactly the same in its construction as the aforementioned electric dust collector with the exception of the construction of the electrodes, the explanation is therefore given only about the distinction between them. In FIGS. 10 through 12, like reference numerals are used to identify like constituent elements as used in FIGS. 7 through 9 and the explanation on such elements is therefore deleted.

Figure 12A:
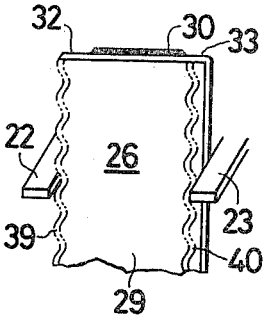
FIG.12(A) is a partially perspective view of the negative electrode.
Figure 12B:
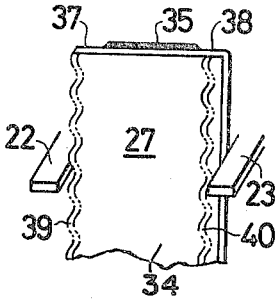
FIG. 12(B) is a partially perspective view of the positive electrode.

As shown in FIG. 12A, the negative electrode 26 consists of the ribbon-like insulation film strip 29 and the ribbon-like metal foil 30 wherein the foil 30 has a width considerably narrower than that of the film 29 and is bonded at the central portion on one face of the film to form the conductive layer in such a manner that both side edges of the foil 30 are positioned sufficiently inwardly from both side edges of the film strip 29, thereby forming the insulation sections 32, 33 respectively having a sufficient width.

Similarly, the positive electrode 27 consists of the ribbon-like insulation film 34 and the ribbon-like metal foil 35 wherein the foil 35 has a width considerably narrower than that of the film 34 and is bonded at the central portion on one face of the film 34 to form a conductive layer in such a manner that both side edges of the foil 35 are positioned sufficiently inwardly from both side edges of the film strip 34, thereby forming the insulation sections 37, 38 having a sufficient width, respectively. This can be seen from FIG. 12B.

Figure 12C:
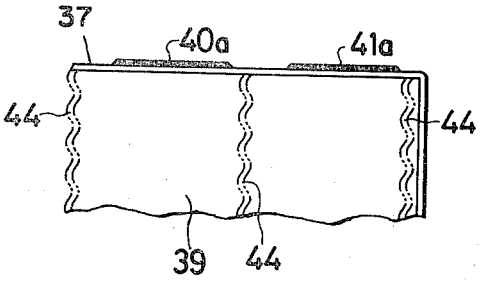
FIG. 12(C) is a partially perspective view of a modified example of the electrode plate.

Between the metal foils 30 and 35 that face each other via the gap between the negative and positive electrodes 26 and 27, there is kept a sufficiently wide space formed by the corrugated convolutions by the insulation sections 37, 38 of the ribbon-like insulation films 29, 34, the support arms 22, 23, and the insulation sections 32, 33. Accordingly, the insulation is markedly improved between the negative and positive electrodes 26 and 27.

Where it is necessary to enlarge the width of the electrodes, the following construction is employed. Namely, as shown in FIG. 12C, a plurality of metal foils 40*a*, 41*a* are bonded onto one face of the ribbon-like insulation film strip 39 in parallel to each other, thereby forming an insulation section also between them. Next, corrugated spacers 44 are disposed on both side edges and at the intermediate portion of the ribbon-like insulation film 39 in order to keep the gap between the electrode plates constant. This construction may also be used when the conductive layers are to be formed on both faces of the film 39.

In this electric dust collector, the charge deposited on the face with no conductive layer is absorbed by the conductive layer on the other face of the film by surface conduction. Hence, this arrangement is free from a build-up of the charge, prevents lowering of the dust collecting efficiency and prolongs the survice life of the apparatus. Since the conductive layer and the surfcae of the insulation section of the electrode plate face each other, it is possible to eliminate spark between the electrode plates and to apply a high voltage. Consequently, the apparatus is free of offensive noise, degradation of the electrode plate due to scorching or melting and the cause of possible fire is eliminated. Moreover, in comparison with the electrode plate having the conductive layers on both sides of the insulation film, the electrode gap can be narrower so that the size of the electric dust collector can be reduced and the dust collecting efficiency can be improved.

In the two kinds of the electric dust collectors described, the spacers are inserted between the electrode plates only at their insulation sections on both side edges but not over their entire surface. Consequently, it is possible to enlarge the space between the electrode plates, to reduce current leakage, to eliminate the voltage drop and to improve the dust collecting efficiency. Since the electrode plate can be prepared from a light and cheap material such as paper or plastic, it is also possible to produce the electric dust collector more economically, to reduce its weight, to enhance its resistance and to remove the particle collecting section and render it a disposal component. The particle collecting section so removed can be subjected to combustion treatment and is therefore free from the occurrence of environmental pollution.

Referring to FIGS. 13 through 21, the explanation will next be given of the electric dust collector using the particle collecting section consisting of electrodes laminated to each other so that each electrode consists of the ribbon-like insulation film strip having the conductive layers formed on both sides thereof.

Figure 13:
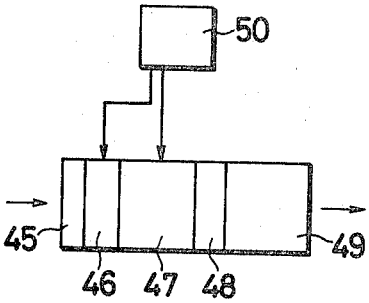

As illustrated in FIG. 13, this electric dust collector is so construction that there are sequentially disposed a pre-filter 45, a charging section 46, a particle collecting section 47, an active carbon filter 48 and a blower 49, in order named from the gas inflow side to the gas outflow side whereby a d.c. high voltage power source 50 is wired to the charging section 46 and to the particle collecting section 47.

Figure 14:
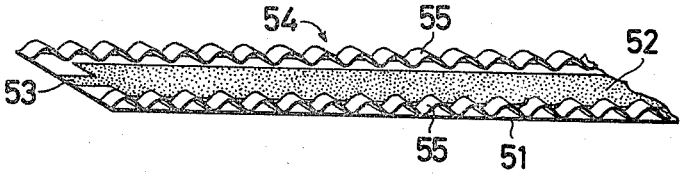
Figure 15:
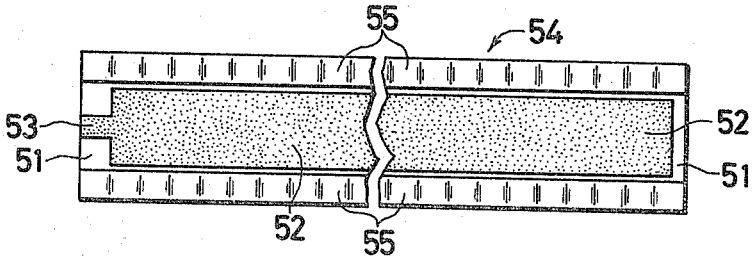
Figure 16:
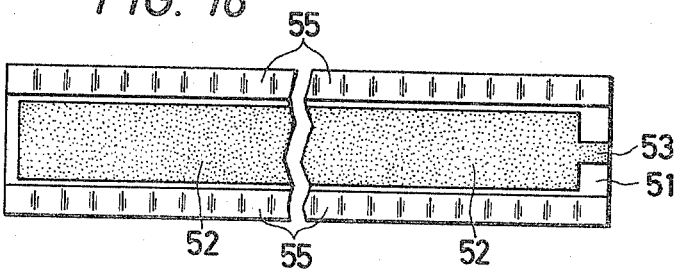

As shown in FIG. 14, the particle collection section 47 has (a) an insulation layer 51 which is an elongated flat strip; (b) a conductive layer 52 which is disposed over the insulation layer between the side edges thereof; (c) a current feed section 53 defined in the conductive layer; and, (d) corrugated spacers 55. The conductive layer is first formed by coating an electrically conductive paint along the central portion of the insulation film 51, i.e., the insulation film can be considered to be an elongated flat rectangular strip, very much like an unwound ribbon, said strip having side edges. The electrically conductive paint is painted between said side edges so that only the central portion of this elongated strip is electrically conductive. A portion of this electrically conductive paint is extended to the side edges so as to define the current feed section 53. Spacers 55 consisting of thinly elongated corrugated paper or plastic are bonded onto one side of the electrode plate 54 along both its side edge portions not applied with the conductive paint in order to allow the passage of the gas therethrough.

Figure 17:
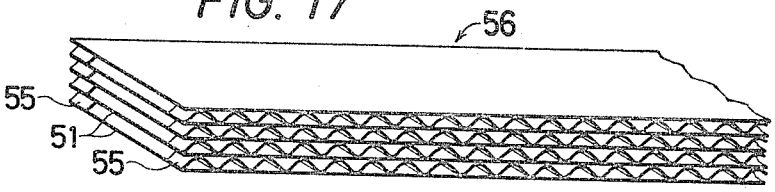
Figure 18:
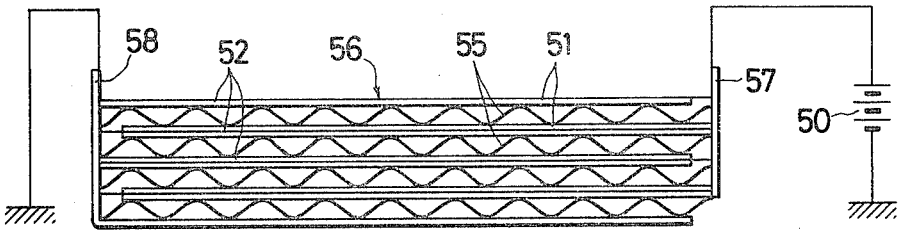

A plurality of electrode plates 54 having the spacers 55 bonded thereto are laminated in such a manner that their current feed sections 53 alternately become opposite each other and the contact portions of the electrode plates 54 having the spacers 55 adjacent to each other are bonded with each other by an adhesive, thereby forming a plate group 56 having the plural electrode plates 54 integrally combined with a predetermined gap between them, as shown in FIG. 17. Among the plate group 56, an electrode plate having the conductive layer formed only on the inner face thereof is used for each of the uppermost and lowermost electrode plates.

In this plate group 56, the current feed sections 53 arranged on one edge portion of every other plate are wired in common by one end of a lead wire 57 of which the other end is connected to the positive terminal of the d.c. high voltage power source 50 while the current feed sections 53 on the other edge portion of every other plate are wired commonly by a lead wire 58 of which other end is connected to the negative terminal of the power source 50, thus forming the particle collecting section 47.

When the blower 49 of this electric dust collector is actuated to let the air containing the dust particles flow in the direction of the arrow, the particles are electrically charged as they pass through the chargng section 46, and are subjected to the Coulomb force between the electrode plates 54 as they pass through the particle collecting section 47 and are collected on the surfaces of these plates 54.

Figure 19:
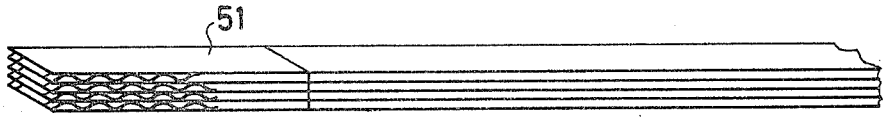
Figure 20:
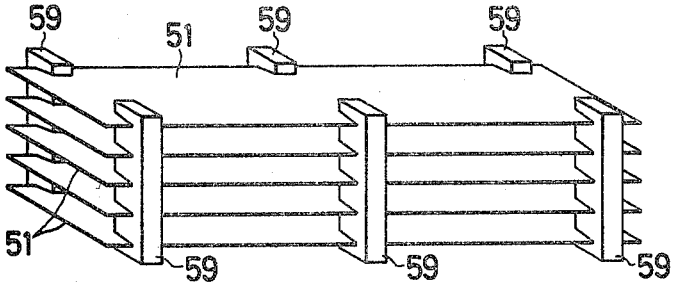
Figure 21:
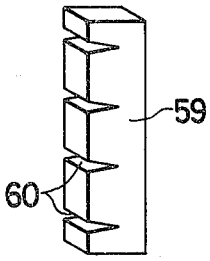

Plate group 56 is generally shaped to match with the size of the space for accommodating the particle collecting section of the electric dust collector. At times, however, the plate group 56 may be shaped in an elongated form as shown in FIG. 19 and be cut in a required length where it is used. Instead of the corrugated spacers 55, comb-shaped spacers 59 may also be used in order that the electrode plates 54 are inserted into slits 60 of the spacers 59 and thus provided with a predetermined gap between them.

If the electrode plates having the conductive layers formed on both sides of the insulation film are laminated to each other by the spacers, fiber-like dust would build up between the electrode plates and bridge them. If the electrode gap is narrowed, occurrence of the spark would then be inevitable. However, it is possible to reduce the spark energy between the electrode plates and to prevent the spark from igniting the inflammable gas by setting the conductivity of the conductive paint to a suitable value.

In FIGS. 22 through 34 there is shown an embodiment wherein the electric dust collector uses a particle collecting section consisting of a laminate of plural electrodes each having the conductive layer formed on one face of the belt-like insulation film.

Figure 22:
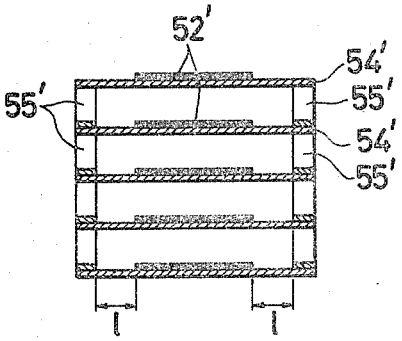

In FIG. 22, reference numeral 54' represents an electrode plate which is formed by deleting the conductive layer 52 from one face of the electrode plate 54 of the electric dust collector. A plurality of such electrode plates 54' are laminated to each other with the corrugated spacers 55 that are bonded to the insulation sections on both side edges of these electrode plates. The contact portions between the electrode plates 54' adjacent to each other via the spacers 55 are bonded with an adhesive, thereby forming the plate group 56' consisting of the plural electrode plates 54' integrally combined with each other with a predetermined gap between them.

In this plate group 56', the current feed sections 53' positioned at one end portion of every other electrode plates are commonly connected to each other by the lead wire 57', of which one end is connected to the positive terminal of the d.c. high voltage power source 50'. On the other hand, the current feed sections 53' at the other end of every other electrode plates are commonly connected by the lead wire 58', of which other end is connected to the negative terminal of the power source 50', thereby forming the particle collecting sections 47' together with the lead wire 57'.

The particle collecting section 47' thus formed is fitted in place of the particle collecting section 47 of FIG. 13 so as to form the electric dust collector.

Figure 23:
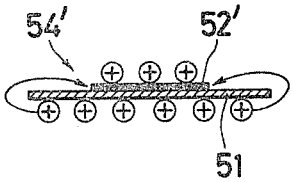
Figure 24:
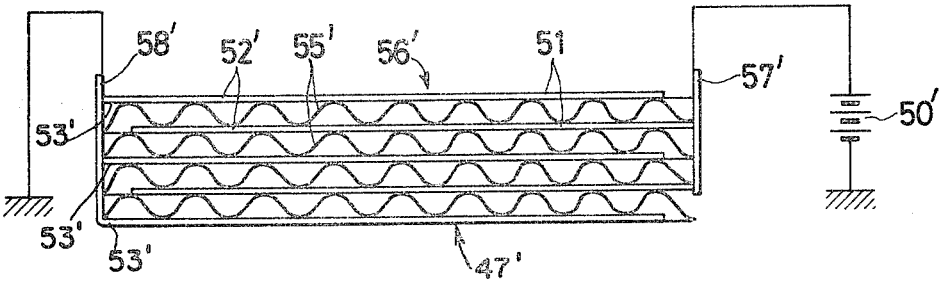
Figure 25:
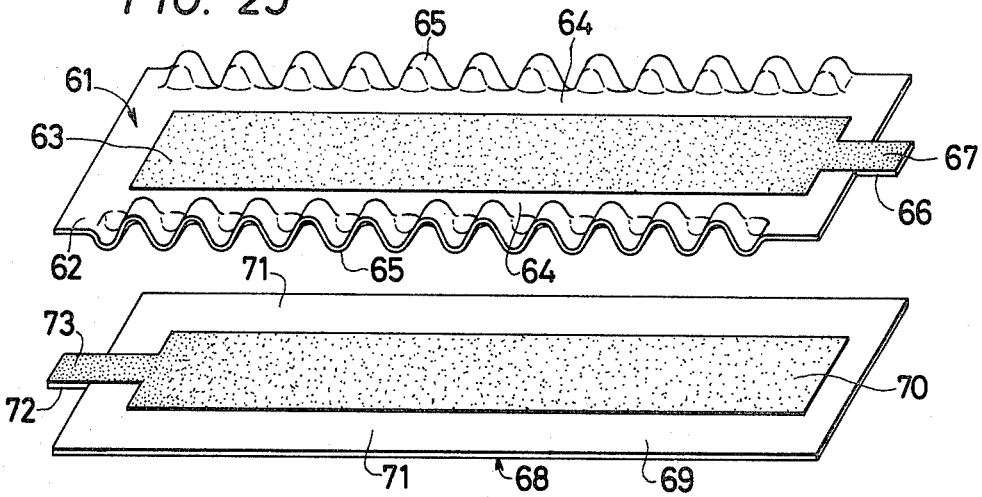
Figure 26:
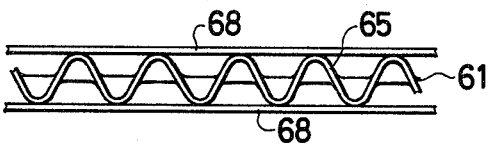
Figure 27:
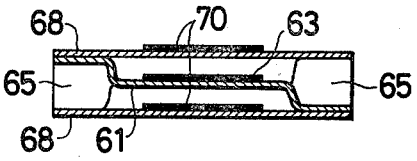

In this electric dust collector, when the charged particles are collected on the surface of the electrode plate 54' as shown in FIG. 23, they are immediately absorbed by the conductive layer 52' at the portion where the conductive layer 52' is exposed, so that they escape into the conductive layer on the opposite surface, that is to say, on the insulation surface, through its front surface. Thus, no charge will build up. On the other hand, when contaminants such as nicotine and tar attach to the surface of the electrode plate 54', the surface resistance decreases and attenuation of the charge takes place within an extremely short time so that the surface becomes electrostatically conductive and not only the portion of the surface having the conductive layer 52' but also the portion having the insulation film function as the electrode. In this manner, the electric field of the dust collecting space does not disappear and the effective electrode area increases, thereby enhancing the dust collecting efficiency.

Since the electrode plates 54' are laminated to each other so that the conductive layers 52' face the insulation surfaces, no spark occurs even when the electrode plates are bridged by fibers, etc. or when the electrode plates are somehow twisted or deformed. It is thus possible to apply a high voltage so as to eliminate offensive noise, prevent degradation of the electrode plates and the cause for possible fire is removed. Further, in comparison with the use of the electrode plates each having the conductive layers on both sides of the insulation film, it is possible to make the electrode gap narrower, to reduce the size of the electric dust collector and to improve the dust collecting efficiency.

The conductive layer in the aforementioned two kinds of electric dust collectors may be formed by vacuum-deposition of a metal, metal plating or bonding of a metal foil in place of the conductive paint. In addition, the electrode plate may be formed either independently of, or integrally with, the electrodes of the charging section.

FIGS. 25 through 34 illustrate modified examples of the particle collecting section, wherein reference numeral 61 represents the electrode plate equipped with a spacer. The conductive layer 63 is formed at the central portion on one face of the insulation film 62 such as a plastic film and the insulation sections 64 on both side edges of the film are corrugated so as to form the spacer sections 65. A contact lug 66 is shaped to extend from the central portion at one end of the insulation film and the current feed section 67 is formed on one face to communicate with the conductive layer 63. Each of the spacer sections 65 is so corrugated that the crests of the corrugated convolutions face in both vertical directions of the film 62 for an equal distance and the gap between the upper peak and the lower peak is twice the gap between the electrode plates when they are laminated with each other. Reference numeral 68 denotes the electrode plate consisting of the insulation film 69 such as a plastic film and the conductive layer 70 formed to extend at the central portion on one face of the insulation film. The insulation sections 71 on both sides of the conductive layer 70 are flat and a contact lug 72 is formed to extend from the central portion on one face of the insulation film 69 so that the current feed layer 73 is formed so as to communicate with the abovementioned conductive layer 70.

Figure 28:
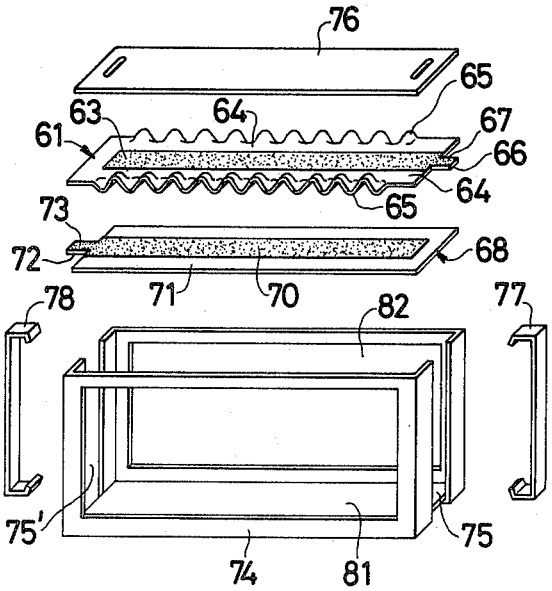
Figure 29:
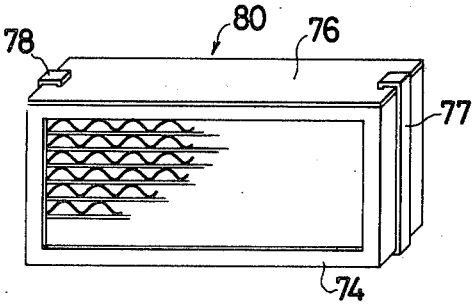
Figure 30:
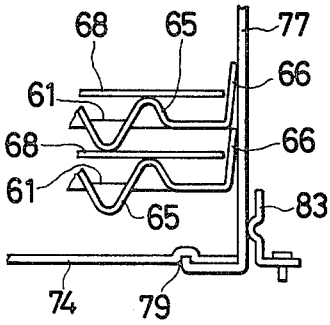

The abovementioned electrode plates 61 and 68 are alternately laminated to each other and incorporated in a case 74 made of an insulation material and having its bottom closed so that the contact lugs 66 of the electrode plates 61 protrude outward through a slit section 75 formed on the right wall of the case 74 while the contact lugs 72 of the electrode plates 68 similarly protrude outward through a slit section 75' formed on the left wall of the case 74. A lid 76 is put on the upper opening of the case 74 to close the same. Electrically conductive plate members 77, 78 equipped at both ends with anchoring sections having a spring effect are fitted to the slit sections 75 and 75' of the case 74 from their outside, respectively, by engaging the anchoring sections with grooves 79 defined in the lid 76 and in the bottom of the case 74, respectively. The particle collecting section 80 is assembled by bringing the plate members 77, 78 into contact with the current feed layers 67, 73, respectively, while the groups of the contact lugs 66, 72 protruding outward from the case 74 are bent as shown in FIG. 30. In FIG. 28, reference numerals 81 and 82 denote openings that are formed on both front and rear walls of the case 74 and allow the passage of the dust-containing gas. In FIG. 30, reference numeral 83 denotes a contact terminal for connecting one terminal, e.g. the positive, of the power source to each electrode plate 61 via the plate member 77. A similar contact terminal is also brought into contact with the plate member 78 so as to connect each electrode plate 68 to the other terminal, e.g. the negative, of the power source.

Figure 31:
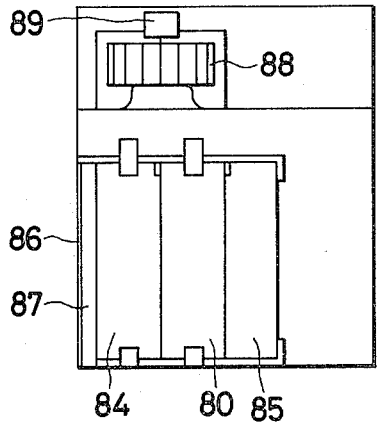

The abovementioned particle collecting section 80 is detachably inserted as a cassette between the charging section 84 and an after-filter 85 of the electric dust collector illustrated in FIG. 31. In this drawing, reference numeral 86 represents an air intake gallery; 87 is a prefilter; 88 is a fan for drawing the air into the dust collector; and 89 is a motor for driving the fan 88.

Figure 32:
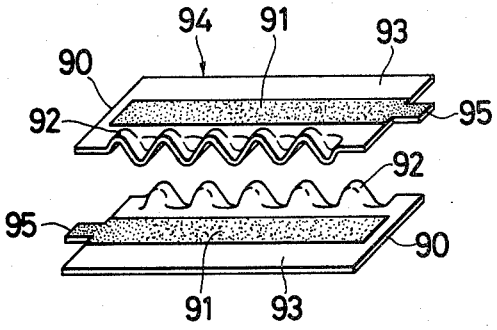
Figure 33:
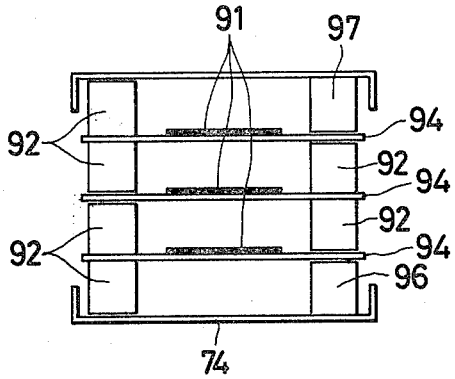
Figure 34:
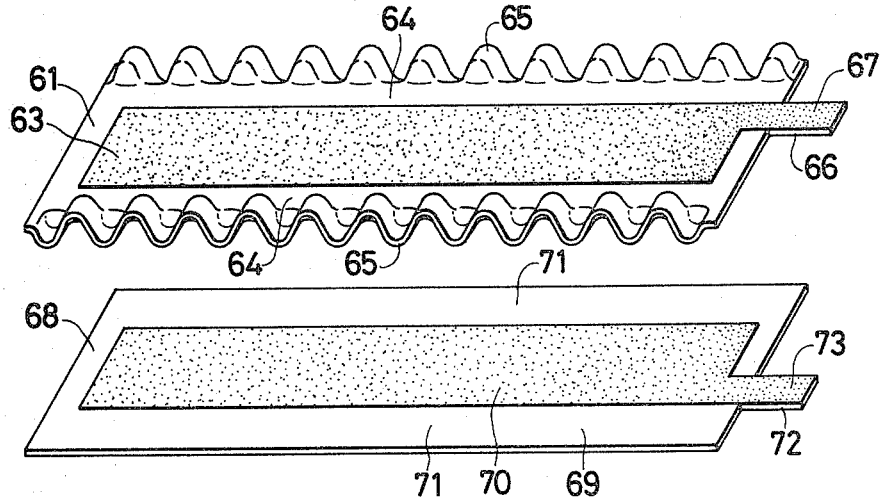

The abovementioned particle collecting section 80 may sometimes be formed in the following manner. Namely, as shown in FIG. 32, one of the insulation sections 92, 93 of each electrode plate 74 on both sides of the conductive layer 91 formed on the insulation film 90 is corrugated while the other is flat, and these electrode plates 94 are laminated to each other in such a manner that their contact lugs 95 alternately face one another. The insulation sections 93, not provided with the spacer, of the first and the last electrode plates 94 are then supported by supports 96, 97 formed protrusively on the lid 76 and the bottom of the case 74 as shown in FIG. 33, thereby forming the particle collecting section 80.

Still alternatively, the particle collecting section 80 may be formed in the following manner. Namely, the contact lugs 66, 72 are provided to the electrode plates 61, 68 at positions separated from each other back and forth with respect to the gas stream. The electrode plates 61, 68 are then alternately laminated to each other and incorporated in the same case as the case 74 so that the contact lugs 66 and 72 are parallel to each other on the same side of the electrode plates 61, 68 and protrude outside the case 74 through the slit sections formed in parallel to each other on the same side of the case.

In the particle collecting section described, the electrode plates can be secured with a predetermined gap between them as they are simply laminated inside the case and their contact lugs protruding outside the case can be brought into electric contact with the electrically conductive plate members when the latter are fitted to the slit sections of the case. Accordingly, the assembly is easy, the cost of production is reduced, the construction becomes simple and the dust collecting performance is equal to the conventional apparatus. Moreover, since a cheap material can be used for the electrode plate and for the case, the dust collecting section can economically be produced in addition to the decrease in the cost of production. When the dust collecting performance decreases due to the dust attaching to the electrode plates of the particle collecting section that is adapted detachably as a cassette to the electric dust collector, the electrode plates are withdrawn from the case and replaced by fresh ones for re-use, or a fresh case with fresh electrode plates as a whole is used for replacement as a fresh dust collecting section. Thus, the dust collecting section advantageously becomes a disposable component.

In the electric dust collector using the laminate-type particle collecting section herein described, each electrode plate consists of the conductive layer having a width narrower than that of the insulation film and formed on said film, and these electrode plates are laminated so as to be spaced apart from each other at their insulation sections on both sides of the conductive layers with a predetermined gap between them via the spacers. Accordingly, no charge is allowed to build up and the leakage current is reduced so that the dust collecting efficiency can be improved. In addition, it is possible to narrow the gap between the electrodes so as to reduce the size and weight of the dust collector and to produce the economical electric dust collector suited for the mass production.

Furthermore, it is to be observed that the charge deposited on the face having no conductive on the insulation film of the electrode plate is absorbed by the conductive layer on the other face of the film due to the surface conduction alone. Hence, this arrangement is free from build-up of the charge, prevents lowering of the dust collection efficiency and prolongs the service life of the apparatus. Since the conductive layer and the surface of the insulation section of the electrode plate face each other, it is possible to eliminate spark between the electrode plates and apply a high voltage. Consequently, the apparatus is free of offensive noise, degradation of the electrode plate due to scorching or melting and can eliminate causes for possible fire. Moreover, in comparison with an electrode plate having conductive layers on both sides of the insulation film, the electrode gap can be narrowed to a greater extent so that the size of the electric dust collector can be reduced and the efficiency of the dust collecting can be improved.

Corrugated insulation spacer sections on both sides of the conductive layer enlarge the space between the electrode plates, to reduce the leakage current, to eliminate the voltage drop and improve the dust collecting efficiency.

We claim:

1. In an electric dust collector, including (a) a case (9) having a longitudinal dust treatment travel path defined therein, with a dust-containing gas inlet (10) on one side of said travel path, a clean gas outlet (11) on the other side of said travel path, and, a dust collection zone having an input side at one end receiving dust-containing gas from said gas inlet and an output side at the other end to discharge clean gas through said gas outlet; the improvement in said dust collection zone comprising:

(b) a charging section (45) on said input side having a corona discharge wire means (42) at said one end and, electrode means (41) within said charging section (45) spaced from said corona discharge wire means (42) whereby gas from the gas inlet (10) passing through said corona discharge wire means (42) is electrically charged in said charging section (45);

(c) a particle collection section in said particle collection zone, intermediate said zone input side and said zone output side, disposed so as to be fed the charged gas which has passed through the charging section (45) said particle collection section having a plurality of particle attracting alternatively positioned parallel positive and negative electrodes, each consisting of a ribbon-like shaped insulating material having side edges, with an electrically conductive layer thereon, spaced from said side edges and of a width considerably narrower than that of the ribbon-like shaped insulating material so as to define insulating sections on both sides of said conductive layer;

(d) insulative spacing arrangement means positioned and arranged with respect to said insulating sections to provide air passage gaps between said electrodes; and, (e) flame arrester net means (47) disposed on the output side to prevent the accidental propagation of fire to the outside of the dust collection zone.

2. A dust collector as claimed in claim 1 wherein said electrodes consist of plates wound spirally.

3. A dust collector as claimed in claim 1 wherein said electrodes consists of plates laminated to each other.

4. A dust collector as claimed in claim 1, wherein said spacing arrangement comprises comb-shaped spacers.

5. A dust collector as claimed in claim 17, said particle collection section including a case means (74), said case means (74) having side walls with slit sections defined in at least one of said side walls, said electrodes being plates and wherein said collection section also includes a contact lug communicating electrically with said conductive layer at least at one of said side edges, said electrode plates being connected to each other by said spacing arrangement and so disposed in said case means that said contact lugs alternatively oppose each other and protrude outside the case means through said slit sections.

* * * * *